United States Patent [19]

Shea

[11] 4,241,383

[45] Dec. 23, 1980

[54] TRAVEL MIRROR

[76] Inventor: John W. Shea, 33 Park Dr., Middletown, N.J. 07748

[21] Appl. No.: 882,034

[22] Filed: Feb. 28, 1978

[51] Int. Cl.[2] ..... F21V 33/00

[52] U.S. Cl. ..... 362/135; 362/136; 362/140; 362/142; 362/144; 362/418; 362/428

[58] Field of Search ..... 362/135, 136, 140, 141, 362/142, 144, 418, 427, 428, 295

[56] References Cited

U.S. PATENT DOCUMENTS

| | | | |
|---|---|---|---|
| 3,381,120 | 4/1968 | Fleisher et al. | 362/136 |
| 3,926,470 | 12/1975 | Marcus | 362/135 |
| 4,023,029 | 5/1977 | Fischer | 362/135 |

*Primary Examiner*—Benjamin R. Padgett
*Assistant Examiner*—J. L. Barr
*Attorney, Agent, or Firm*—David A. Jackson

[57] ABSTRACT

A cosmetic mirror comprising a mirror housing having a centrally-located aperture therein, lighting means mounted within the housing laterally adjacent the aperture, a mirror assembly comprising two back-to-back mirrors pivotally mounted within the aperture, a rotatable support stand attachment secured to the housing, comprising a rotatable cylindrical support bar having a center aperture section therein, end aperture sections therein, a first set of meshing gears within the end aperture sections, spring means operatively communicating at one end thereof with the meshing gears and at the opposite end thereof with the end aperture sections of the rotatable support bar for outwardly biasing the meshing gears in the end aperture sections, and a second set of meshing sections fixed to the mirror housing at the base thereof or fixed to guide rails slidably secured within said mirror housing at the base thereof for contacting the first set of meshing gears in a meshing arrangement.

A removable support stand and cover means is also provided for securing the mirror housing at a plurality of angular positions and also acting as a protective cover assembly for the mirror assembly when the cosmetic mirror is not being used. The removable support stand and cover means is prepared from a U-shaped flexible material and is of cross-sectional configuration. The free ends of the support stand and cover means have tabs thereon adapted to releaseably engage the center aperture of the support bar to secure the support stand and cover means to the bar.

15 Claims, 8 Drawing Figures

TRAVEL MIRROR

BACKGROUND OF THE INVENTION

This invention relates to a removable stand and cover for a cosmetic mirror. More particularly, this invention relates to a removable stand and cover for a cosmetic mirror in which the removable cover is also utilized as a removable stand for supporting the mirror in a plurality of angular positions.

The employment of cosmetic mirrors is well known in the art. These mirrors find special utility in their portable nature for utilization or long distance trips. Such portable mirrors have frequently included a pivotal mirror having opposite plain and magnifying surfaces. See for example, U.S. Pat. No. 3,824,001. Still other prior art mirrors have utilized a similar arrangement with the addition of a lighting means surrounding the mirror. See for example, U.S. Pat. Nos. 3,526,763 and 3,381,120.

One of the problems with such mirrors is the lack of any suitable means for supporting the mirror at various angular positions. The above cited prior art mirrors disclose a flat stand that is hinged to the mirror. However, these stands cannot easily and conveniently fix the mirror at a desired angular position. Additionally, these stands are very unstable and constantly slip from their supporting positions. Moreover, the angular variation of support of these stands is very limited.

A further disadvantage of the prior art cosmetic mirrors is the lack of any means to protect the mirror from breakage while retaining the lightweight, portable nature of the mirror. U.S. Pat. No. 3,381,120 discloses a protective carrying case for the mirror. However, this bulky protective case detracts from the desired characteristics of the cosmetic mirror, e.g., lightness and compactness. U.S. Pat. No. 3,794,828 discloses a cosmetic mirror having integrally-hinged, protective, mirror doors. However, the mirror assembly is bulky in itself, does not have a pivotable mirror and has no removable cover assembly. Moreover, the hinged doors when opened detract from the compact nature of the cosmetic mirror, an essential characteristic of the mirror.

A still further disadvantage of the prior art cosmetic mirrors is the need for an AC power source for illuminating the lights surrounding the mirror. Thus, if an AC power source is not available, the lights cannot be used.

The cosmetic mirror of the present invention is believed to provide the solutions to the aforementioned problems.

SUMMARY OF THE INVENTION

In accordance with the present invention, a cosmetic mirror is disclosed comprising a mirror housing having a centrally-located aperture therein and lighting means mounted within the housing, laterally adjacent the aperture, and a mirror assembly pivotally mounted within the aperture, the mirror assembly comprising two back-to-back mirrors, one back-to-back mirror having a magnified reflection surface and the other mirror having a normal reflection surface. The cosmetic mirror also comprises a rotatable support stand attachment secured to the housing, comprising a rotatable support bar having a center aperture section therein, end aperture sections therein, a first set of meshing gears within the end aperture sections, spring means operatively communicating at one end thereof with the meshing gears and at the opposite end thereof with the end aperture sections of the rotatable support bar for outwardly biasing the meshing gears in the end aperture sections, and a second set of meshing sections fixed to the mirror housing at the base thereof or fixed to guide rails slidably secured within said mirror housing at the base thereof for contacting the first set of meshing gears in a meshing arrangement.

A removable support stand and cover means is also provided for securing the mirror housing at a plurality of angular positions, the support stand and cover means also being a protective cover assembly for the mirror assembly when the cosmetic mirror is not being used. The removable support stand and cover means is of a U-shaped, cross-sectional configuration, the free ends of the U-shaped support stand and cover means having tabs thereon for releaseably securing the support stand and cover means to the rotatable support bar of the rotatable support stand attachment, the tabs sitting within the center aperture section of the rotatable support bar.

Accordingly, it is a principal object of the present invention to provide a cosmetic mirror having a removable support stand and cover which may be utilized to secure the mirror at a plurality of angular positions, and also acting as a protective cover assembly for the mirror when the cosmetic mirror is not being utilized.

It is a further object of the present invention to provide a cosmetic mirror having a removable support stand and cover which can easily fix the mirror at a desired angular position without slipping.

It is a still further object of the present invention to provide a cosmetic mirror in which the removable support stand can support the mirror in a wide angular variation.

it is a yet further object of the present invention to provide a cosmetic mirror in which a mirror protecting means is provided while retaining the lightweight, compact and portable nature of the mirror.

It is another object of the present invention to provide a cosmetic mirror having a removable support stand and cover which does not detract from the aesthetic and compact nature of a cosmetic mirror.

It is still another advantage of the present invention to provide a cosmetic mirror which can utilize a DC power source for illuminating the lights surrounding the mirror.

Further objects and advantages will become apparent to those skilled in the art from the ensuing description which proceeds with reference to the accompanying figures.

DESCRIPTION OF THE PREFERRED EMBODIMENTS

Figure 1:
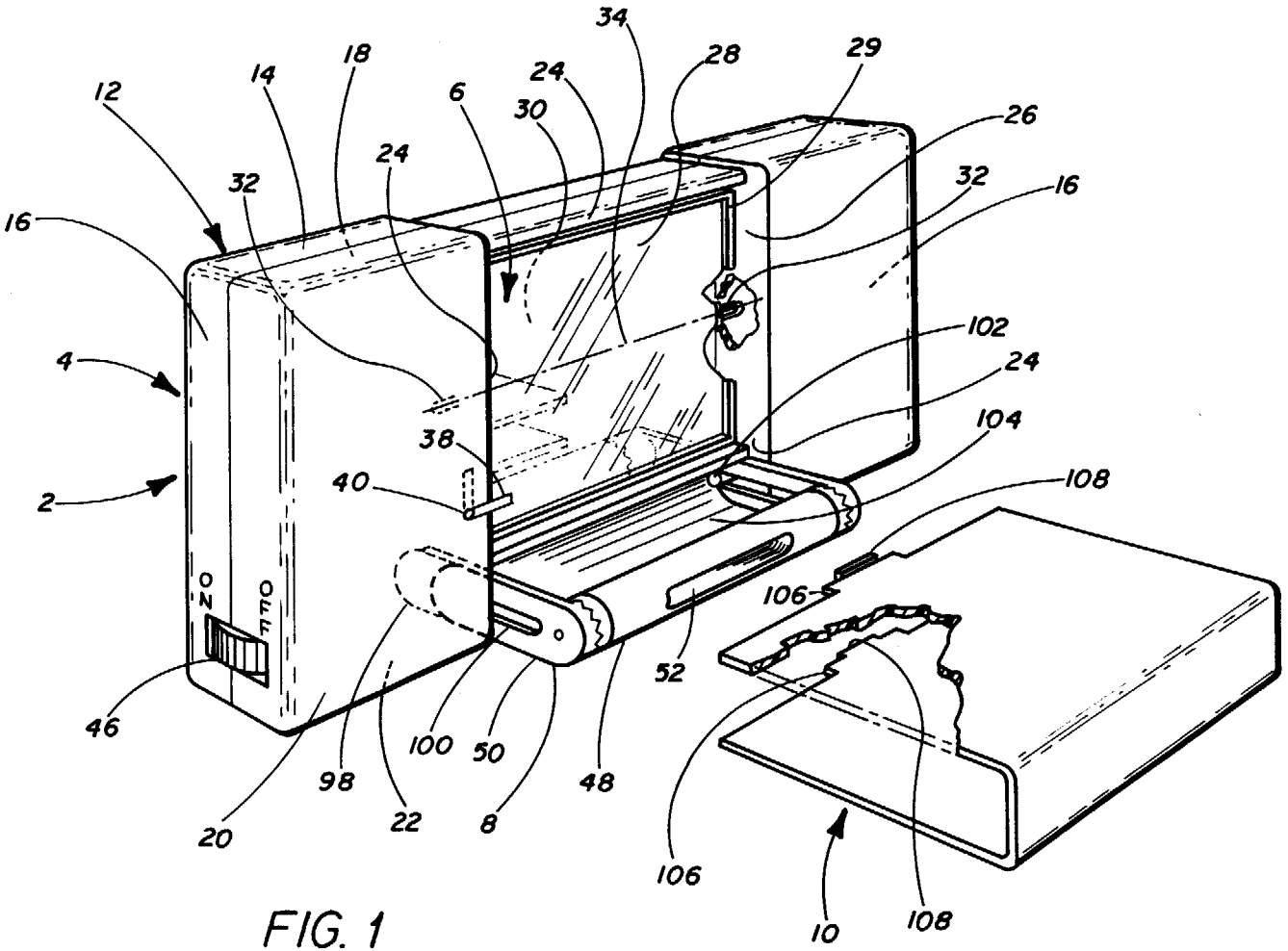
FIG. 1 is a perspective view of the cosmetic mirror of the present invention in its unsupported position.
Figure 2:
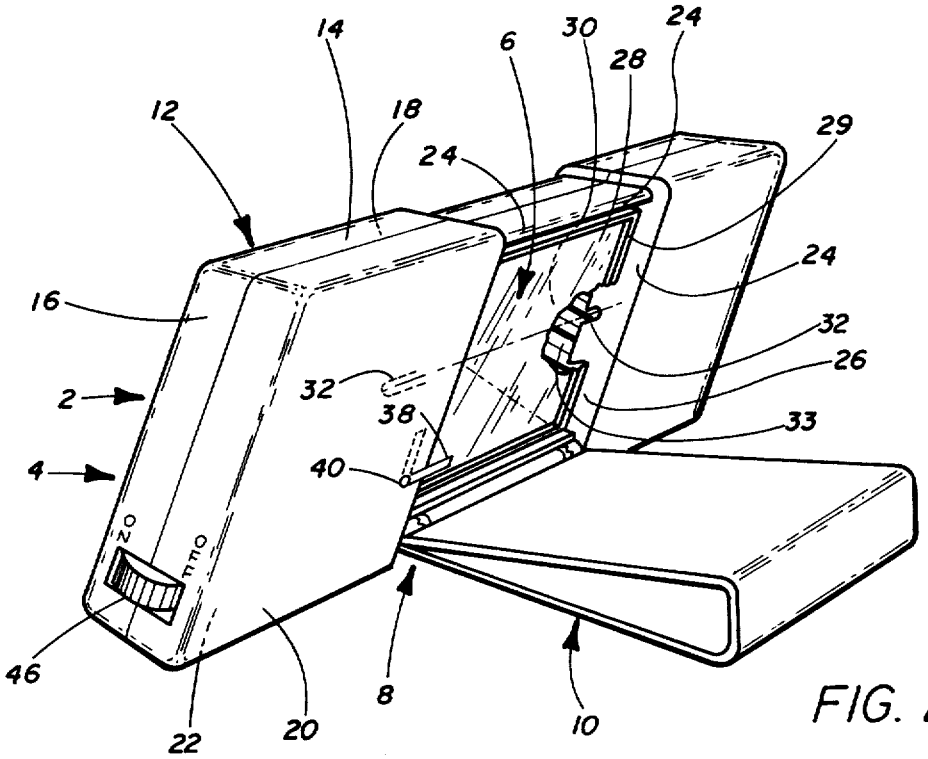
FIG. 2 is a perspective view of the cosmetic mirror of the present invention in its supported position.

Referring to the figures wherein like numerals designate like parts, and specifically to FIGS. 1 and 2, a cosmetic mirror assembly 2 is shown in a first embodiment to comprise a mirror housing 4, a cosmetic mirror assembly 6 pivotally attached within the housing 4, a rotatable support stand attachment 8 secured to housing 4, and a removable support stand and cover 10 for fixedly supporting the mirror assembly at a plurality of desired angular positions. Mirror housing 4 comprises a substantially rectangular box-like element 12 having top wall 14, side walls 16, front wall 18, rear wall 20 and bottom wall 22.

Figure 4:
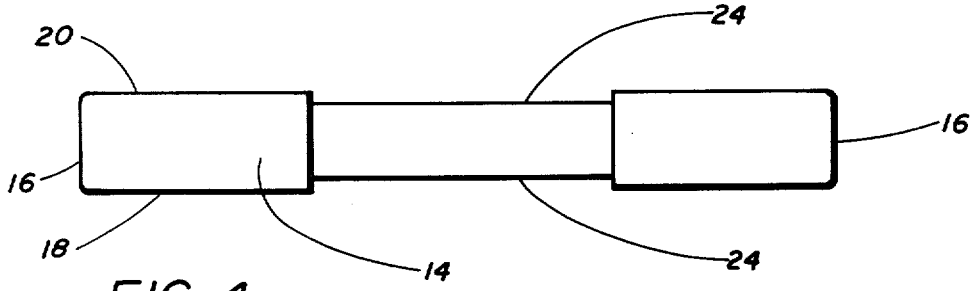
FIG. 4 is a top plan view of the mirror housing of the present invention.

Referring to FIGS. 1 and 4, front wall 18 and rear wall 20 include a recessed section 24 extending from top wall 14 to bottom wall 22, the recessed sections 24 for both walls being of equal width and equal displacement from side walls 16.

Referring to FIGS. 1 and 2, housing 4 also includes an aperture 26 extending through front wall 18 and rear wall 20, the aperture 26 being disposed within the area of recessed sections 24. Aperture 26 is preferably of a rectangular configuration but is not so limited.

Disposed within aperture 26 is a cosmetic mirror assembly 6 comprising two back-to-back mirrors attached to each other by any suitable means, such as by mirror frame 29, one mirror 28 having a magnified reflection surface and the other mirror 30 having a normal reflection surface. Such suitable means may also include a plastic mirror backing 33. Cosmetic mirror assembly 6 is of a similar dimension and shape as aperture 26 in housing 4 and is pivotally attached therein by means of pivot pins 32 fixedly attached to opposite sides of cosmetic mirror assembly 6 and on the same imaginary line 34 therethrough, pivot pins 32 being of a substantially cylindrical configuration. Pivot pins 32 revolve within grooves (not shown) in housing 4. This may be accomplished by manufacturing the housing 4 in two halves, each half including half of the groove, wherein the mirror assembly 6, with pivot pins 32, is placed within one half of the housing 4 and the other half is then attached to the first half to form an integral housing 4 having a mirror assembly 6 contained therein.

Additionally, any suitable means may be utilized to retain cosmetic mirror assembly 6 in the same inclined position as housing 4 when the latter is supported in a desired angular position. As shown in FIG. 2, a latch 38 is rotatably secured to rear wall 20, adjacent cosmetic mirror assembly 6, by pivot pin 40. In this manner, the latch, as shown, is set in its mirror securing position to retain cosmetic mirror assembly 6 in the desired angular position and is turned to its dashed position when the other side of cosmetic mirror assembly 6 is desired to be utilized so as to allow rotation of mirror 6 about pivot pins 32.

Figure 3:
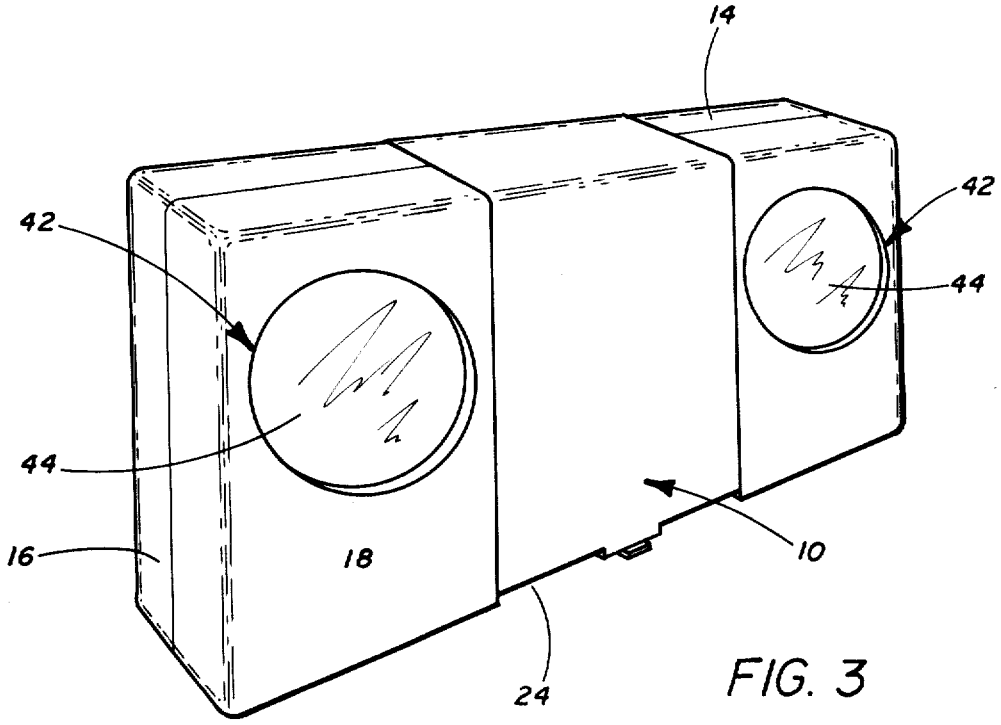
FIG. 3 is a perspective view of the cosmetic mirror of the present invention in its storage position.

Referring to FIG. 3, housing 4 includes lighting means 42 within front wall 18 adjacent cosmetic mirror assembly 6 on its lateral sides. Lighting means 42 includes two singular incandescent lights (not shown) located on lateral sides of cosmetic mirror assembly 6 and a translucent recessed screen 44 covering each light to prevent any glare to the user. Additionally, the lights are powered by a DC power source. In this manner, there is no need for a user to locate an AC socket, a disadvantage inherent in prior art cosmetic mirrors, especially during long trips. As shown in FIG. 1, a standard on-off switch 46 is provided on one of side walls 16 to actuate lighting means 42.

Figure 5:
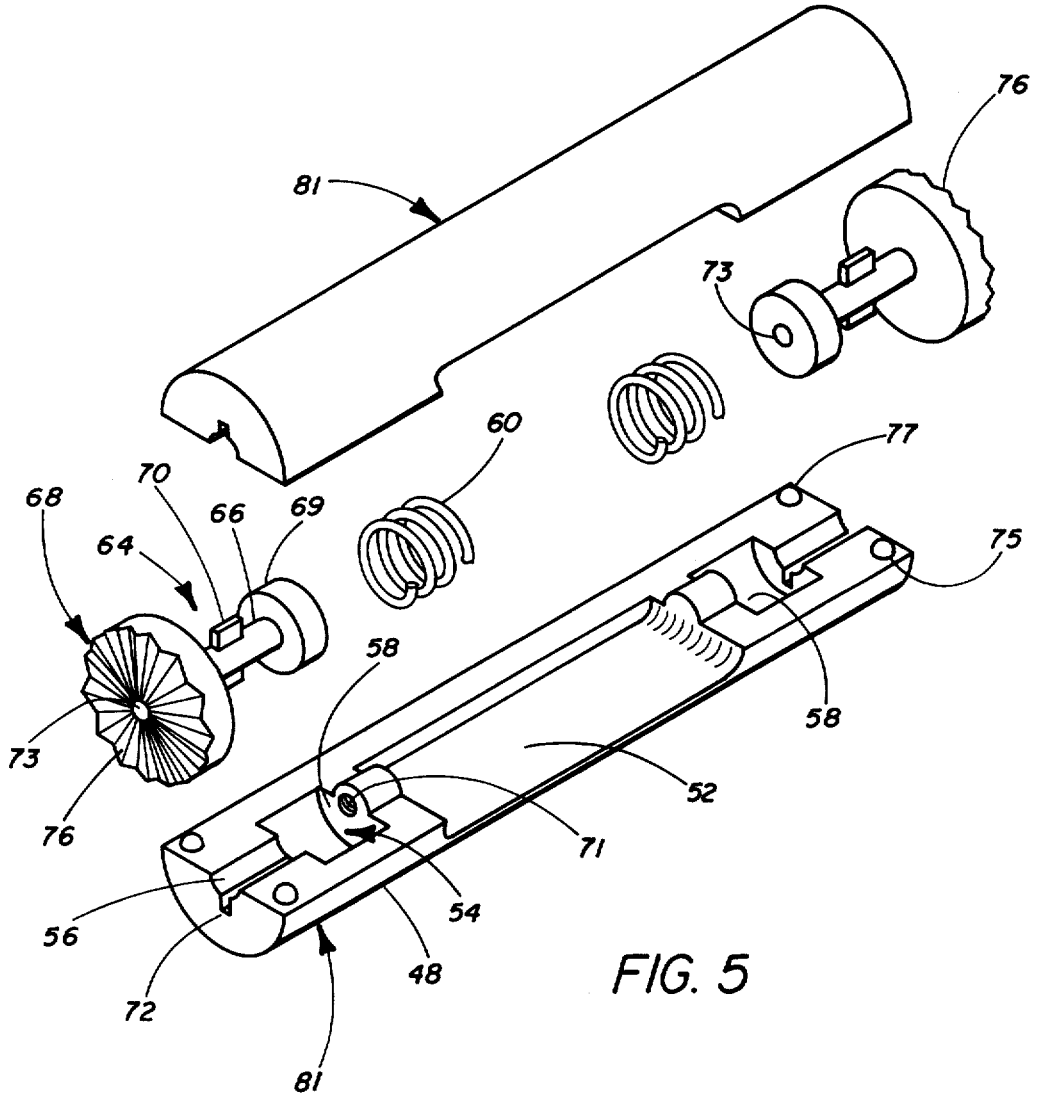
FIG. 5 is an exploded view of the rotatable support bar of the present invention.
Figure 6:
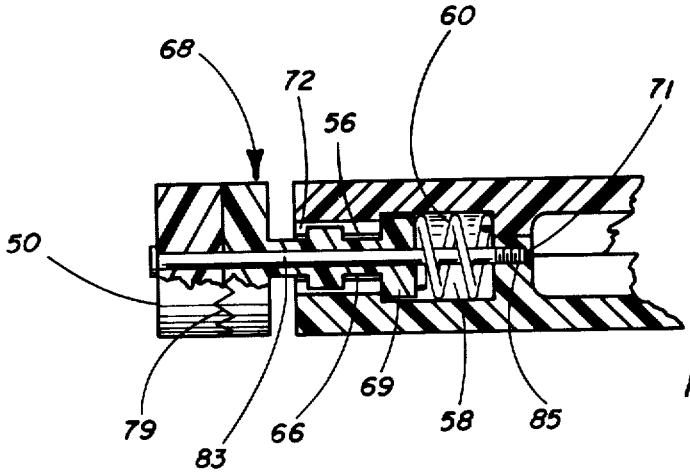
FIG. 6 is a partial, side, cross-sectional view of the rotatable support stand attachment of the present invention, illustrating the meshing sections in a meshing relation.

Referring to FIGS. 1 and 5, a rotatable support stand attachment 8 is secured to housing 4 at the lower end of rear wall 20. The stand attachment 8 comprises a generally cylindrical support bar 48 rotatably mounted on guide rails 50. Support bar 48 includes a central aperture section 52 and two end aperture sections 54, end aperture sections 54 comprising journals 56 in open communication with the outside of cylindrical support bar 48 and cylindrical apertures 58 in open communication with the journals 56. Apertures 58 also include centrally located, screw-threaded apertures 71 in their end walls. Disposed within each cylindrical aperture 58 is a spring 60 operatively communicating with the rear wall thereof. Operatively communicating with the opposite side of spring 60 is a gear 64 having shaft 66, meshing section 68 and restraining cylinder 69, to which spring 60 is in operative contact, for outwardly biasing gear 64, as shown in FIG. 6. Stem 66 of each gear 64 includes key sections or fins 70 thereon, as shown in FIG. 5. These key sections 70 fit within corresponding key openings 72 in journals 56, as shown in FIG. 5. In this manner, gears 64 are limited in their individual motions in a linear direction in end aperture sections 54, e.g., gears 64 are prevented from moving in a rotational direction without cylindrical support bar 48 moving in the identical rotational direction and magnitude. Meshing section 68 of gear 64 includes teeth 76 on its end face, as shown in FIGS. 5 and 6. In addition, gear 64 preferably includes a centrally located aperture 73 through its entire length.

Cylindrical support bar 48 is preferably manufactured in two equal sections 81, as shown in FIG. 5. Each section includes half of end aperture sections 54 and central aperture section 52 and aligning male member 75 and female members 77. The sections form a cylinder when mated together and may be fixedly secured by any suitable means, such as glue or the like.

Referring to FIG. 1, each guide rail 50 comprises a generally elongate, rectangular bar which is slidably secured at one end within mirror housing 4 at the base thereof on both sides of mirror 6. Any suitable means may be utilized to slidably retain guide rail 50 within housing 4. For example, an open or track 98 may be provided in housing 4 at the base thereof on both sides of mirror 6, having similar dimensions to guide rails 50 such that guide rails 50 may be slidably retained therein. Additionally, guide rails 50 may comprise an elongate central opening 100 through which a pin 102 rides therein, pin 102 being fixedly attached within track 98 such that guide rails 50 are limited in their slidable movement and prevented from escaping housing 4. Guide rails 50 extend from housing 4 at right angles therefrom and are at right angles to cylindrical support bar 48.

Figure 7:
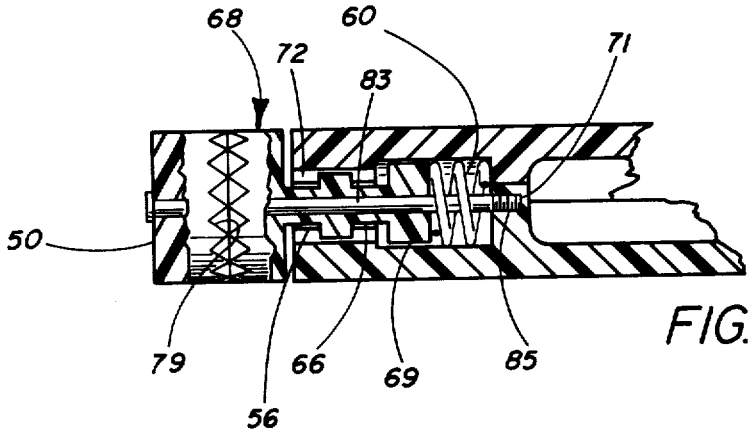
FIG. 7 is a partial, side, cross-sectional view of the rotatable support stand attachment of the present invention illustrating the meshing sections in a non-meshing relation.

Referring to FIGS. 6 and 7, at the opposite ends of each guide rail 50 is a guide rail meshing section 79 on the inner face thereof. Each meshing section 79 corresponds to meshing section 68 of gear 64. In addition, through the center of meshing section 79 is an aperture (not shown), the aperture passing through both sides of each guide rail 50.

In constructing the rotatable support stand attachment, and referring to FIG. 5, gears 64 and springs 60 are placed in end aperture sections 54 of one support bar section 81, as previously described. Key sections 70 are aligned with key openings 72. Thereupon, the other support bar section 81 is aligned with and fixedly attached to the first section 81 to form cylindrical support bar 48. Gears 64 are then depressed and cylindrical support bar 48 is placed between the free ends of guide rails 50. Gears 64 are then released so as to mate with meshing sections 70 on guide rails 50. Referring to FIG. 6, a securing bolt 83, having a screw-threaded end section 85, is then inserted through the aperture of guide rail 50, and aperture 73 of gear 64 and is screw-threadedly received within aperture 71 in the end wall of cylindrical aperture 58. Bolt 83 is secured within aperture 71 so as to allow gear 64 and guide rail 50 to rotate thereabout and to allow gear 64 to move in a linear direction in end aperture 54. In addition, securing bolt 83 prevents cylindrical support bar 48 from being accidently removed from guide rails 50.

As shown in FIG. 1, housing 4 includes an indented, hemispherical recess section 104 at the base of rear wall 20 such that when guide rails 50 are disposed within housing 4 to their fullest extent, cylindrical support bar 48 is fully disposed within recess section 104 to prevent obstruction of cover 10, to be later discussed.

Alternatively, cylindrical support bar 48 may be fixedly retained within circular recess section 104. If this embodiment is utilized, there would be no need for guide rails 50. In addition, meshing section 79 would be permanently disposed within mirror housing 4 so as to mesh with gears 64.

Referring to FIGS. 1 and 2, removable support stand and cover 10 comprises a generally U-shaped member of a preferably rectangular configuration, removable support stand and cover 10 also comprising tabs 106 of a generally rectangular configuration, attached to support stand and cover 10 at the free ends of the U-shaped member at the center thereof. Additionally, tabs 106 include out-turned sections 108 at right angles from the free end of tabs 106, to be later discussed. Removable support stand and cover 10 is preferably of a flexible plastic material such that tabs 106 of the free ends thereof may be pushed together so as to contact one another.

Figure 8:
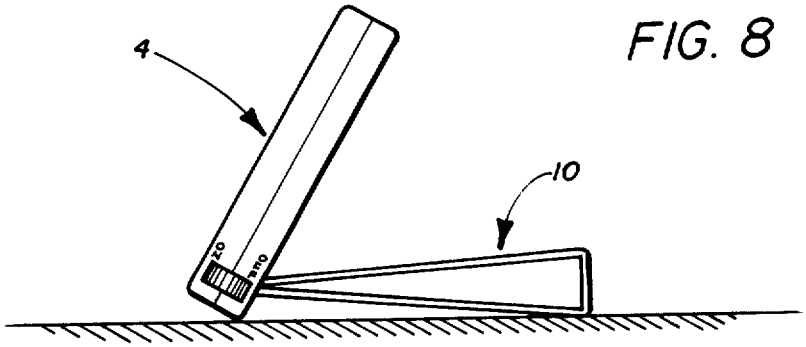
FIG. 8 is a schematic view of the present invention in an angular position.

In operation, guide rails 50 and consequently, cylindrical support bar 48, are pulled outward along openings or tracks 98 in housing 4, whereupon tabs 106 of support stand and cover 10 are pushed together into contact with one another and inserted within central aperture section 52 of cylindrical support bar 48. Once the tabs 107 are within central aperture section 52, the flexible nature of U-shaped member 10 urges tabs 106 apart, thus releasably securing support stand and cover 10 within cylindrical support bar 48. Guide rails 50 and consequently, cylindrical support bar 48 and support stand and cover 10, are then slidably moved within housing 4 to their fullest extent such that cylindrical support bar 48 rests within recess section 104 of housing 4, as shown in FIG. 2. At this point, mirror housing 4 may be rotated about its base to any desired position. This latter result is achieved by rotating mirror housing 4 about its base, causing meshing section 79 to rotate with respect to stationary gear 64, gear 64 being held from rotating by cylindrical support bar 48 and support stand and cover 10. Referring to FIG. 7, meshing section 79, upon the teeth thereof riding upon the teeth of gear 64, causes gear 64 to be pushed toward the center of cylindrical support bar 48, causing spring 60 to become compressed. When the teeth of meshing section 79 pass over teeth 76 so as to mesh again with teeth 76, spring 60 forces gear 64 into meshing engagement with meshing section 79. This cycle is repeated until the desired angular position of mirror housing 4 with respect to support stand and cover 10 is obtained. Upon reaching the desired angular position, spring 60 will force gear 64 and section 79 into meshing engagement so as to retain mirror housing 4 in the desired angular position, as shown in the schematic drawing of FIG. 8.

Upon reaching the desired angular position, one reflecting side of mirror 6 is chosen by the user, and mirror 6 is rotated about pins 32 to achieve this result, whereupon latch 38 is rotated to secure mirror 6 in that position.

When the mirror is in its storage position, as shown in FIG. 3, cylindrical support bar 48 is disposed within recess section 104 of housing 4 and support stand and cover 10 is placed over housing 4 at the center thereof, such that the side walls of U-shaped member 10 are disposed within recesses 24 of housing 4. In this manner, support stand and cover 10 can be utilized as a storage cover and as a removable support stand.

It is to be understood that the invention is not limited to the illustrations described and shown herein, which are deemed to be merely illustrative of the best modes of carrying out the invention, and which are suitable of modification of form, size, arrangement of parts, and details of operation. The invention rather is intended to encompass all such modifications which are within the spirit and scope as defined by the claims.

What is claimed is:

1. A cosmetic mirror comprising:

(a) a planar mirror housing:

(b) a mirror assembly having two broad surfaces and secured within said housing;

(c) a rotatable support stand attachment secured to said housing, said support stand attachment disposed with its axis of rotation parallel to the plane containing said housing, and adjacent to said mirror assembly; and (d) a cover means for securing the broad surfaces of said mirror assembly, said cover means detachable attachable to said mirror housing, said cover means adapted to straddle said mirror housing and provide nesting reception for said housing and said mirror assembly when said cosmetic mirror is not being utilized, wherein said cover means, when detached from said mirror assembly, is detachable attachable to said support stand attachment and cooperates with said support stand attachment to define an angularly adjustable support stand for independently supporting said cosmetic mirror in a plurality of angular positions relative to the vertical plane.

2. The cosmetic mirror of claim 1 wherein said mirror housing includes a centrally-located aperture therein, said mirror assembly being pivotally mounted within said aperture, and said mirror assembly comprising two back-to-back mirrors, one back-to-back mirror having a magnified reflection surface and the other mirror having a normal reflection surface.

3. The cosmetic mirror of claim 1 wherein said mirror housing comprises lighting means mounted within said housing laterally adjacent said mirror assembly.

4. The cosmetic mirror of claim 1 wherein said mirror housing is of a generally rectangular configuration.

5. The cosmetic mirror of claim 1 wherein said removable support stand and cover means is of a U-shaped, cross-sectional configuration, the free ends of said U-shaped support stand and cover means having tabs thereon.

6. The cosmetic mirror of claim 1 wherein said rotatable support stand attachment comprises a rotatable support bar having an aperture section therein for releasably securing said removable support stand and cover means thereto.

7. The cosmetic mirror of claim 6 wherein said rotatable support bar comprises end aperture sections therein, a first set of meshing gears within said end aperture sections, and spring means operatively communicating at one end thereof with said meshing gears and at the opposite end thereof with said end aperture sections of said rotatable support bar for outwardly biasing said meshing gears in said end aperture sections.

8. The cosmetic mirror of claim 7 wherein said rotatable support stand attachment comprises a second set of meshing sections fixed to said mirror housing at the base thereof for contacting said first set of meshing gears in a meshing arrangement.

9. The cosmetic mirror of claim 7 wherein said rotatable support stand attachment includes guide rails slidably secured within said mirror housing at the base thereof.

10. A cosmetic mirror comprising:

(a) a planar rectangular mirror housing having a centrally-located aperture therein and lighting means mounted within said housing, laterally adjacent said adjacent said aperture;

(b) a mirror assembly pivotally mounted within said aperture, said mirror assembly comprising two broad surfaces, said broad surfaces defined by two back-to-back mirrors, one back-to-back mirror having a magnified reflection suface and the other mirror having a normal reflection surface;

(c) a rotatable support stand attachment secured to said housing, said support stand attachment disposed with its axis of rotation parallel to the plane containing said housing, and adjacent to said mirror assembly; and (d) a cover means for the broad surfaces of said mirror assembly, said cover means detachable attachable to said mirror housing, said cover means adapted to straddle said mirror housing and provide nesting reception for said housing and said mirror assembly when said cosmetic mirror is not being utilized, Wherein said cover means, when detached from said mirror assembly, is detachable attachable to said support stand attachment and cooperates with said support stand attachment to define an angularly adjustable support stand for independently supporting said cosmetic mirror in a plurality of angular positions relative to the vertical plane.

11. A cosmetic mirror comprising:

(a) a rectangular mirror housing having a centrally-located aperture therein and lighting means mounted within said housing, laterally adjacent said aperture;

(b) a mirror assembly pivotally mounted within said aperture, said mirror assembly comprising two back-to-back mirrors, one back-to-back mirror having a magnified reflection surface;

(c) a rotatable support stand attachment secured to said housing; and (d) a removable support stand and cover means for securing said mirror housing at a plurality of angular positions, said support stand and cover means also being a protective cover assembly for said mirror assembly when said cosmetic mirror is not being utilized.

12. The cosmetic mirror of claim 10 wherein said rotatable support stand attachment comprises a rotatable support bar having a center aperture section therein, end aperture sections therein, a first set of meshing gears within said end aperture sections, and spring means operatively communicating at one end thereof with said meshing gears and at the opposite end thereof with said end aperture sections of said rotatable support bar, for outwardly biasing said meshing gears in said end aperture sections.

13. The cosmetic mirror of claim 11 wherein said rotatable support stand attachment comprises a second set of meshing sections fixed to said mirror housing at the base thereof for contacting said first set of meshing gears in a meshing arrangement.

14. The cosmetic mirror of claim 11 wherein said rotatable support stand attachment includes guide rails slidably secured within said mirror housing at the base thereof, said guide rails comprising a second set of meshing sections fixed to the free ends thereof for contacting said first set of meshing gears in a meshing arrangement.

15. The cosmetic mirror of claim 12 wherein said removable support stand and cover means is of a U-shaped, cross-sectional, configuration, the free ends of said U-shaped support stand and cover-means having tabs thereon for releasably securing said support stand and cover means to said rotatable support bar of said rotatable support stand attachment.

* * * * *